US005490402A

United States Patent [19]

Shieh

[11] Patent Number: 5,490,402

[45] Date of Patent: Feb. 13, 1996

[54] PADLOCK

[76] Inventor: Jin-Ren Shieh, No. 178, Shih Chia Rd., Taichung, Taiwan

[21] Appl. No.: 139,731

[22] Filed: Oct. 22, 1993

[51] Int. Cl.[6] ..... E05B 67/22

[52] U.S. Cl. ..... 70/39; 70/43

[58] Field of Search ..... 70/39, 38 C, 38 R, 70/38 B, 28, 46, 233, DIG. 20, 367, 360, 42, 43

[56] References Cited

U.S. PATENT DOCUMENTS

| | | | |
|---|---|---|---|
| 1,347,467 | 7/1920 | Scott | 70/38 R |
| 1,526,728 | 2/1925 | Wagner | 70/43 |
| 1,616,449 | 2/1927 | Horak | 70/38 C |
| 1,873,462 | 10/1930 | North | 70/DIG. 20 |
| 4,009,599 | 3/1977 | Patriquin | 70/DIG. 20 |
| 4,064,716 | 12/1977 | Shwayder | 70/39 |
| 4,545,224 | 10/1985 | Zane | 70/39 |
| 4,888,967 | 12/1989 | Kuo | 70/54 |
| 4,918,949 | 4/1990 | Newbold | 70/39 |
| 5,133,203 | 7/1992 | Huang | 70/360 |
| 5,174,138 | 12/1992 | Shen | 70/360 |
| 5,195,340 | 3/1993 | Huang | 70/360 |
| 5,379,618 | 1/1995 | Shieh | 70/233 |
| 5,410,895 | 3/1995 | Hsu | 70/28 |

*Primary Examiner*—Steven N. Meyers
*Assistant Examiner*—Gary Estremsky
*Attorney, Agent, or Firm*—Browdy and Neimark

[57] ABSTRACT

A padlock has a lock body, a shackle, a lock bolt, and a lock bolt control mechanism. The shackle comprises two parallel arms capable of being retained and locked respectively in two receptacles of the lock body. One of the two arms can be drawn to become detached from the lock body. The lock bolt is caused to move to join with the end portion of one of the two arms at the time when the end portions of both arms are retained and locked in the two receptacles. The lock bolt control mechanism is housed in the lock body and is connected with the lock bolt. The lock bolt control mechanism can be caused by a key to move from a locking state corresponding to a connecting position of the lock bolt to an unlocking state in which the lock bolt is caused to move axially from the connecting position to a disconnecting position which is not corresponding to a bolt connecting portion of the shackle arm.

3 Claims, 3 Drawing Sheets

PADLOCK

FIELD OF THE INVENTION

The present invention relates generally to a lock, and more particularly to an improved padlock.

BACKGROUND OF THE INVENTION

The conventional padlock comprises a body in which a lock is disposed such that a lock core of the lock can be turned by a key. The lock core is fastened with a retaining member rotatable in conjunction with the lock core. As the lock is positioned in a locking state, the retaining member is caused to rotate to position itself in a retaining position corresponding to the locking state, thereby causing the end of the arm of the shackle to be so retained that the end of the shackle arm can not be pulled out forcibly from the inside of the body of the padlock. In other words, the shackle arm of the conventional padlock is arrested by means of the rotatable retaining member. As a result, the conventional padlock can be easily tampered with by hitting violently the padlock body so as to cause the retaining member to turn involuntarily to release the shackle arm. In addition, the body of the conventional padlock must be hollow so that there is room for the retaining member to turn. Such hollow body of the conventional padlock is vulnerable to sabotage or burglary by means of a saw.

SUMMARY OF THE INVENTION

It is therefore the primary objective of the present invention to provide an improved padlock which is less likely than the prior art padlock to be tampered with by a person who hits violently the padlock body.

It is another objective of the present invention to provide an improved padlock which is less vulnerable than the prior art padlock to sabotage done by means of a saw.

The foregoing objectives of the present invention are accomplished by a padlock which comprises a lock body, a shackle, a lock bolt, and a lock bolt control mechanism. The shackle has two arms parallel to each other. Each of the two arms has an end portion which is retained in the receptacle of the lock body. The end portion of one of the two arms can be released completely by the receptacle. The lock bolt can be so guided as to move to a connecting position in the lock body at the time when the two arms are respectively caused to move to a locking position in the receptacles, thereby enabling the lock bolt to be connected with a bolt connecting portion located at the end portion of at least one shackle arm. As a result, the connected end portion can not be drawn out from the receptacle. The lock bolt control mechanism is operated by a key and is disposed in the lock body such that the lock bolt control mechanism is coupled with the lock bolt. The lock bolt control mechanism can be caused by the key to move from a locking state to an unlocking state at which the lock bolt is no longer coupled with the bolt connecting portion. The padlock of the present invention is characterized in that the lock body has a longitudinal axis. The lock bolt is mounted to one end of the longitudinal axis of the lock body such that the lock bolt can be caused to move along the longitudinal axis between a connecting position and a disconnecting position, and that the longitudinal axis is almost perpendicular to the end portions of the two shackle arms.

The lock bolt control mechanism of the present invention comprises a lock cylinder housing, a lock cylinder and a lock cylinder core. The lock cylinder housing is fastened to one end of the longitudinal axis of the lock body. The lock cylinder is disposed in the lock cylinder housing such that the lock cylinder can be caused to move axially by means of a locating pin for a predetermined distance in the lock cylinder housing. The lock cylinder core is coupled coaxially with the lock bolt and is prevented from moving axially by a restraining pin at the time when the lock cylinder core is in a locking state. In the meantime, the lock bolt is confined to the connecting position corresponding to the locking state. The lock cylinder core can be caused to turn by a key to be in a unlocking state, thereby resulting in the lock cylinder and the lock bolt to move axially from the connecting position to the disconnecting position which is not corresponding to the bolt connecting portion of the shackle arm.

DETAILED DESCRIPTION OF THE INVENTION

Figure 1:
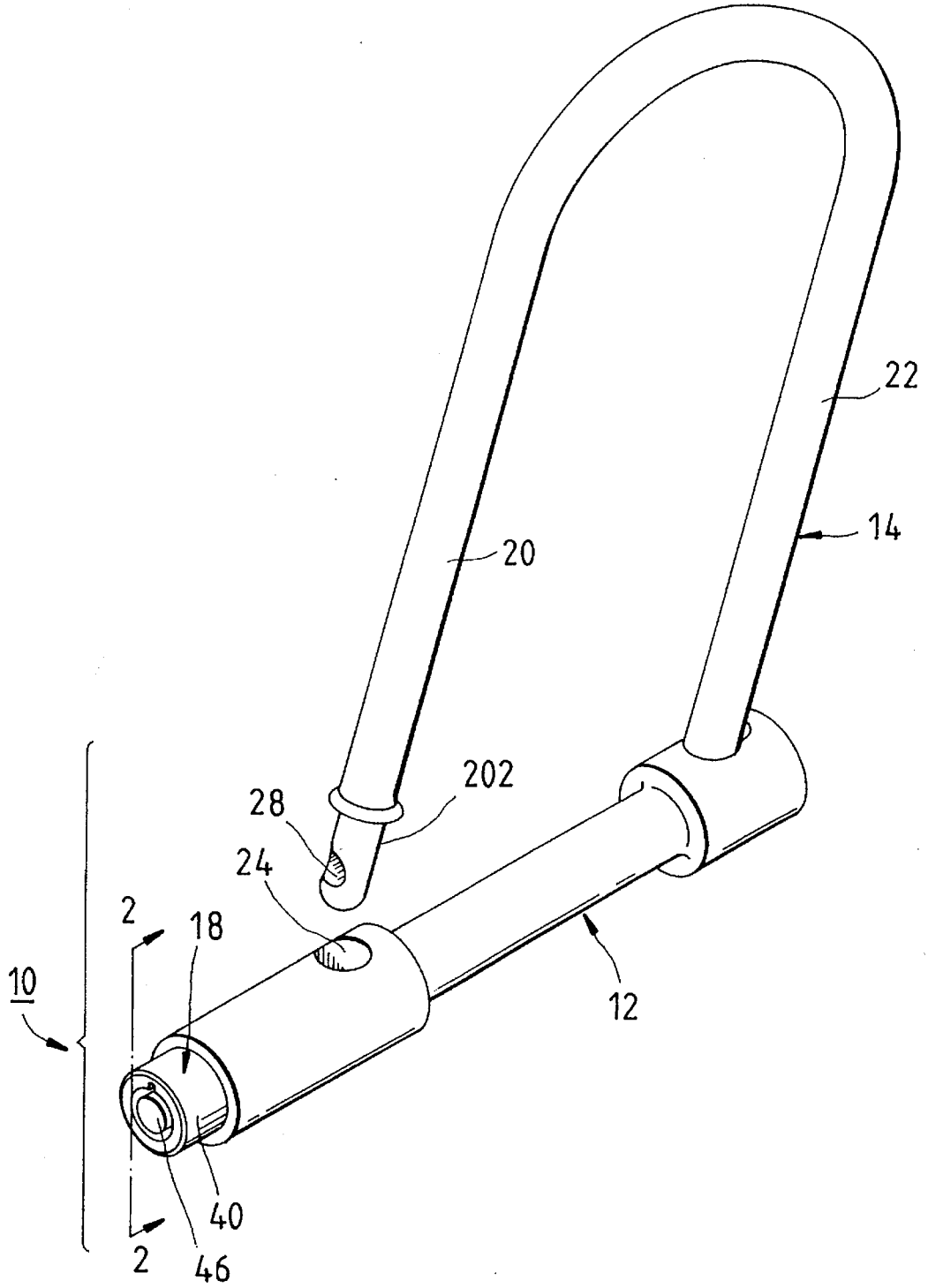
FIG. 1 shows a perspective view of a first preferred embodiment of the present invention in an unlocking state.
Figure 2:
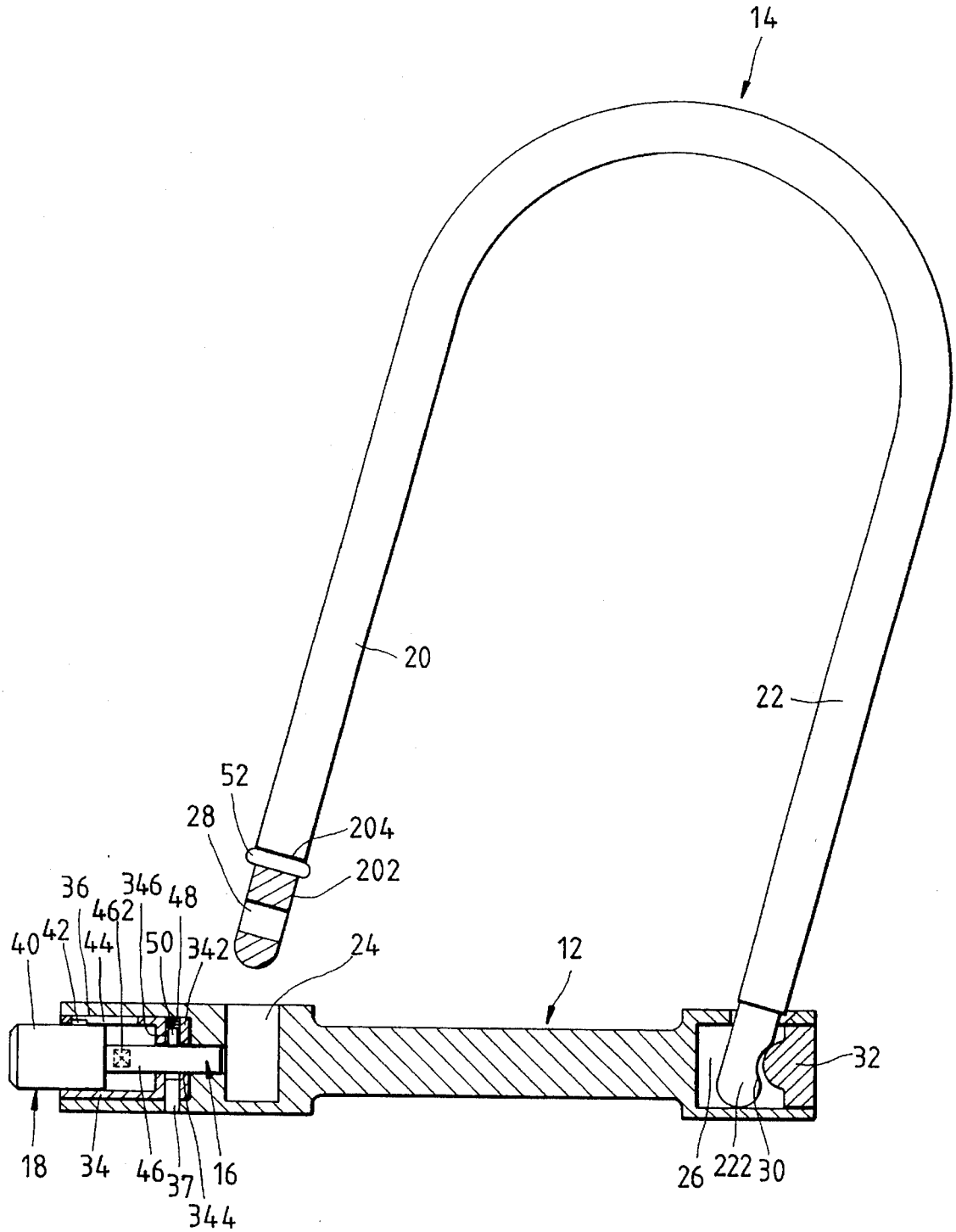
FIG. 2 shows a sectional view of the first preferred embodiment and taken along the line 2—2 as shown in FIG. 1.
Figure 3:
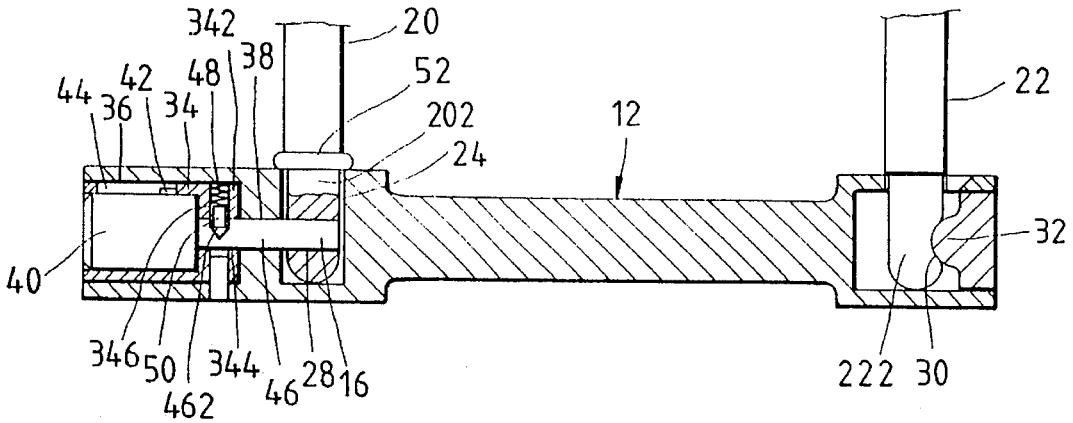
FIG. 3 shows a sectional view of the first preferred embodiment of the present invention in a locking state, with the sectional view being taken in the direction similar to the line 2—2 as shown in FIG. 1.

Referring to FIGS. 1–3, a padlock 10 of the first preferred embodiment of the present invention is shown to comprise a lock body 12, a shackle 14, a lock bolt 16, and a lock bolt control mechanism 18.

The lock body 12 of a solid rod body has a longitudinal axis with both ends thereof being larger in outer diameter than a body portion thereof. The shackle 14 has two arms 20 and 22, which are parallel to each other and are provided respectively with end portions 202 and 222. The end portions 202 and 222 of the shackle arms 20 and 22 are inserted vertically into two receptacles 24 and 26, which are disposed respectively in both ends of the longitudinal axis of the lock body 12.

The end portion 202 of the first arm 20 is provided with a through hole 28 while the end portion 222 of the second arm 22 is furnished with a recess 30. The lock bolt 16 is situated at a connecting position perpendicular to the through hole 28 at the time when both arms 20 and 22 are respectively retained in a locking position in the receptacles 24 and 26. In the meantime, the recess 30 of the second arm 22 is caused to fit over a projection 32 located in the second arm receptacle 26. As a result, the end portions 202 and 222 can not be released from the receptacles 24 and 26. The open end of the second arm receptacle 26 is of an oblong construction, thereby enabling the end portion 222 of the second arm 22 to be inserted into or pulled out of the receptacle 26 without difficulty.

The lock bolt control mechanism 18 has a lock cylinder housing 34, which is disposed in a receiving space 36 located in one end of the longitudinal axis of the lock body 12. The lock cylinder housing 34 is fixed in the receiving space 36 by means of a fixing pin 37. The lock cylinder housing 34 has a bottom wall 342, which is in communication with the first arm receptacle 24 via a passage 38. The lock bolt control mechanism 18 further has a lock cylinder 40, which is received in the lock cylinder housing 34 such that a locating pin 42 of the lock cylinder 40 is inserted into an elongate hole 44 so as to enable the lock cylinder 40 to move axially for a distance equal to the length of the elongate hole 44. The lock bolt control mechanism 18 still further has a lock cylinder core 46, which is disposed in the lock cylinder 40 such that the lock cylinder core 46 can be turned by a key. The structural details of the lock cylinder core 46 are not related to the present invention and will not be therefore described here. The lock bolt 16 is made coaxially and integrally with the tail end of the lock cylinder core 46 and is put through an axial hole 344 disposed in the bottom wall 342 of the lock cylinder housing 34. When the lock bolt 16 is in a locking state, a restraining pin 50, which is received in a receiving cell 346 of the bottom wall 342 of the lock cylinder housing 34 and which is urged by a coil spring 48, is caused to insert into a recessed portion 462 having sloping sides as shown in FIG. 2 so as to avert the axial movement of the lock cylinder core 46. In the meantime, the lock bolt 16 is caused to pass through the through hole 28 via the passage 38 to be restrained at the connecting position, as shown in FIG. 3. As the lock cylinder core 46 is turned by a key to be in the unlocking state, the restraining pin 50 moves up the sloped sides of the recessed portion 462 on to the outer periphery of lock bolt 16 so as to enable the lock cylinder core 46 to move outwards along with the lock cylinder 40 and the lock bolt 16 in the axial direction for a distance which is the distance that the lock cylinder 40 is capable of moving, As a result, the lock bolt 16 is situated at a position away from the through hole 28, as shown in FIG. 2, thereby enabling the end portions 202 and 222 of the shackle arms 20 and 22 to be released respectively from the receptacles 24 and 26. In order to prevent the rain water from entering the lock body 12 via the receptacle 24, the end portion 202 of the shackle arm 20 has an outer diameter smaller than the outer diameter of the arm 20. As a result, a shoulder face 204 is formed at the juncture between the arm 20 and the end portion 202 to facilitate the fitting of a rubber washer 52. As the end portion 202 of the shackle arm 20 is locked in the receptacle 24, the rubber washer 52 is attached intimately to the open end of the receptacle 24.

Figure 4:
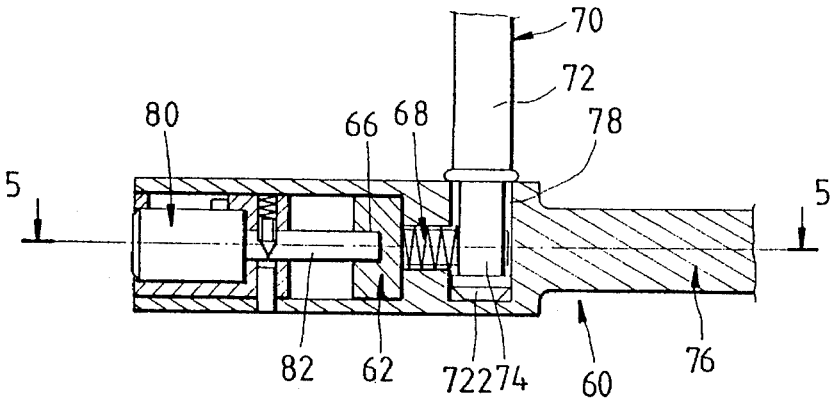
FIG. 4 shows a sectional view of a second preferred embodiment of the present invention in a locking state, with the sectional view being taken in the direction similar to the line 2—2 as shown in FIG. 1.
Figure 5:
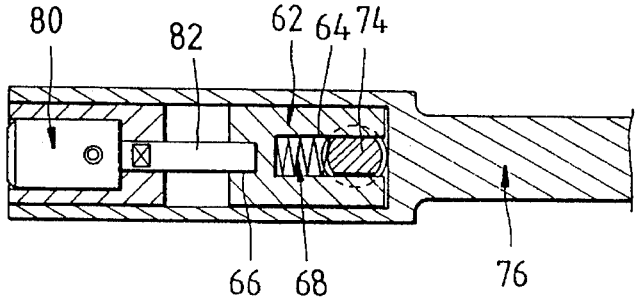
FIG. 5 shows a sectional view of a portion taken along the line 5—5 as shown in FIG. 4.

Now referring to FIGS. 4 and 5, a padlock 60 of the second preferred embodiment of the present invention is shown to comprise a lock bolt 62 which is provided at one end thereof with a dent 64 and at another end thereof with a recess 66. A coil spring 68 is disposed in the dent 64. The padlock 60 has a shackle 70 comprising an arm 72 which is provided at the end portion 722 thereof with an annular waist portion 74 engageable with the dent 64 of the U-shaped receptor of the lock bolt 62 after the arm 72 has been situated at the locking position at the bottom in a receptacle 78 of a lock body 76. The padlock 60 further comprises a lock bolt control mechanism 80, which is provided with a lock cylinder core 82 extending into the recess 66. As a result, when the lock cylinder core 82 is caused to move inwards and axially to be in the locking state, the lock bolt 62 is pushed to arrive at a connecting position when the U-shaped receptor is joined around the annular waist portion 74 of the shackle arm 72. When the lock cylinder core 82 is turned by a key to move outwards and axially, the lock bolt 62 is urged by the coil spring 68 to move outwards and axially to be situated at a disconnecting position wherein the U-shaped receptor is not joined with the annular waist portion 74.

What is claimed is:

1. A padlock comprising:

a lock body having a central portion;

a cross-section through said central portion being uniformly solid through the longitudinal length of said central portion;

a first recess and a second recess respectively located at opposite ends of said central portion;

a shackle having a first arm and a second arm which are parallel to each other;

a first end of said first arm and a second end of said second arm being respectively insertable into said first recess and said second recess into a locking position;

said second end and said second recess having engagement means for engaging the second end to the second recess when in the locking position;

said engagement means preventing said second end from being disengaged from said second recess when in the locking position;

a bolt moveable in said lock body to engage said first end when in the locking position;

a lock bolt control mechanism operated by a key and housed in said lock body;

said lock bolt control mechanism being coupled with said lock bolt to control engagement and disengagement of the lock bolt with the first end when the lock bolt mechanism is turned by the key;

said engagement means permitting the first end to be disengaged from said lock bolt and detached from said first recess before the second end can be disengaged from said second recess;

wherein said lock body has a longitudinal axis;

said lock bolt moving along an axial line of said longitudinal axis between being engaged or disengaged from said first end, said axial line being substantially perpendicular to said first end and second end when in the locking position, wherein said lock bolt control mechanism comprises a lock cylinder housing coaxially fixed at an end of said lock body;

a lock cylinder coaxially slidable in said lock cylinder housing;

a locating pin limiting axial movement of said lock cylinder;

a lock cylinder core coaxially fixed to said lock bolt;

said lock cylinder core being engaged to said first end when said key is turned in a first direction and removed from said lock bolt control mechanism;

a restraining pin holding said lock cylinder core in engagement with said first end when said key is removed;

said lock cylinder core being disengaged from said first end when said key is inserted and turned in a second direction in said lock bolt control mechanism, wherein said lock bolt is provided with a U-shaped end and wherein said first end is formed with an annular waist portion which engages in said U-shaped end when the key is turned in the first direction and the key removed.

2. The padlock of claim 1 wherein said lock bolt is provided with a recess which receives said lock cylinder core.

3. The padlock of claim 1 wherein a coil spring is engaged within said U-shaped end.

* * * * *